US010508800B2

(12) United States Patent
Waters

(10) Patent No.: US 10,508,800 B2
(45) **Date of Patent: *Dec. 17, 2019**

(54) LIGHT BUTTON DEVICE

(71) Applicant: Michael Waters, Aspen, CO (US)

(72) Inventor: Michael Waters, Aspen, CO (US)

(73) Assignee: Waters Industries, Inc., West Dundee, IL (US)

( * ) Notice: Subject to any disclaimer, the term of this patent is extended or adjusted under 35 U.S.C. 154(b) by 272 days.

This patent is subject to a terminal disclaimer.

(21) Appl. No.: 15/605,399

(22) Filed: May 25, 2017

(65) Prior Publication Data

US 2017/0356637 A1 Dec. 14, 2017

Related U.S. Application Data

(63) Continuation of application No. 14/216,545, filed on Mar. 17, 2014, now Pat. No. 9,664,366.

(60) Provisional application No. 61/792,932, filed on Mar. 15, 2013.

(51) Int. Cl.

| | |
|---|---|
| ***F21V 23/04*** | (2006.01) |
| ***F21S 9/02*** | (2006.01) |
| ***F21L 4/04*** | (2006.01) |
| ***F21L 4/00*** | (2006.01) |
| ***F21L 4/02*** | (2006.01) |
| ***F21L 2/00*** | (2006.01) |

(52) U.S. Cl.

CPC ..... *F21V 23/04* (2013.01); *F21S 9/02* (2013.01); *F21L 2/00* (2013.01); *F21L 4/00* (2013.01); *F21L 4/005* (2013.01); *F21L 4/022* (2013.01); *F21L 4/027* (2013.01); *F21L 4/04* (2013.01); *F21L 4/045* (2013.01); *F21V 23/0414* (2013.01); *F21V 23/0421* (2013.01); *F21V 23/0428* (2013.01)

(58) Field of Classification Search

CPC ..... F21V 23/0421; F21V 23/0428; F21V 23/0414

See application file for complete search history.

(56) References Cited

U.S. PATENT DOCUMENTS

| | | | |
|---|---|---|---|
| 1,187,574 | A | 6/1916 | Wachtel |
| 1,470,776 | A | 10/1923 | Stevenson |
| 1,673,436 | A | 6/1928 | Barany |
| 1,816,877 | A | 8/1931 | Emerson |
| 1,866,600 | A | 7/1932 | Frank |
| 1,995,141 | A | 3/1935 | Barber |
| 2,041,843 | A | 5/1936 | Liftschitz |

(Continued)

OTHER PUBLICATIONS

Namco, Proper Application of Limit Switches General Information: print out from WayBack Machine.org indicating date of posting, May 10, 2012.

(Continued)

*Primary Examiner* — Bryon T Gyllstrom
*Assistant Examiner* — Colin J Cattanach
(74) *Attorney, Agent, or Firm* — Fitch, Even, Tabin & Flannery LLP

(57) ABSTRACT

Compact light devices are described herein that are advantageously configured to be secured to a surface in order to provide inexpensive lighting forwardly therefrom. The compact light devices can include on and off configurations in order to preserve battery life and allow a user to selectively energize the light source.

10 Claims, 6 Drawing Sheets

(56) References Cited

U.S. PATENT DOCUMENTS

| | | | | |
|---|---|---|---|---|
| 2,059,029 | A | 10/1936 | Pryor | |
| 2,151,910 | A * | 3/1939 | Graubner | F21V 23/0414 200/558 |
| 3,924,117 | A | 12/1975 | Brindley | |
| 4,347,553 | A | 8/1982 | Saron | |
| 5,158,356 | A | 10/1992 | Guthrie | |
| 5,386,351 | A | 1/1995 | Tabor | |
| 6,394,621 | B1 | 5/2002 | Hanewinkel | |
| 6,520,660 | B1 | 2/2003 | Ho | |
| 6,629,989 | B2 | 10/2003 | Akita | |
| 9,664,366 | B2 * | 5/2017 | Waters | F21V 23/04 |
| 2001/0001259 | A1 | 5/2001 | Gilmer | |
| 2001/0030858 | A1 | 10/2001 | Krietzman | |
| 2003/0137833 | A1 | 7/2003 | Hsu | |
| 2005/0018419 | A1 * | 1/2005 | Parsons | F21L 4/005 362/116 |
| 2007/0041180 | A1 | 2/2007 | Wallace | |
| 2012/0318985 | A1 * | 12/2012 | Bushee | A01K 27/006 250/342 |

OTHER PUBLICATIONS

Namco, Proper Application of Limit Switches General Information, p. 1; "cam" definition.

* cited by examiner

FIG. 7
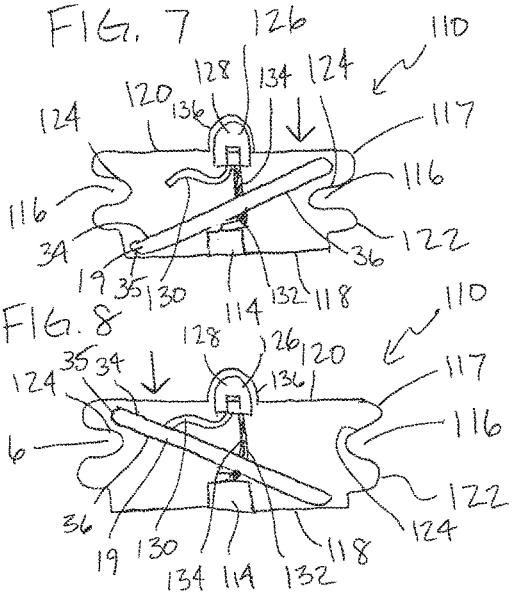
FIG. 8
FIG. 9
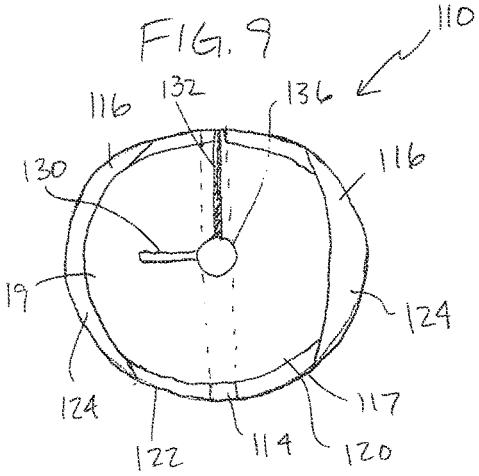
FIG. 10
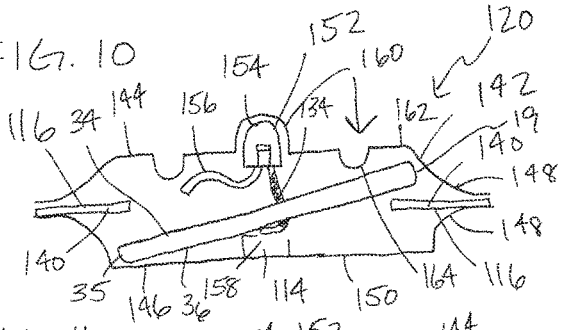
FIG. 11
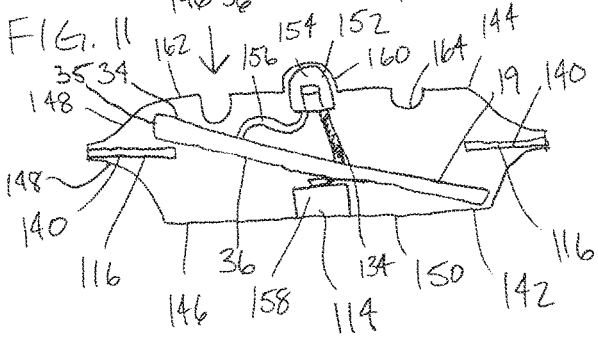
FIG. 12
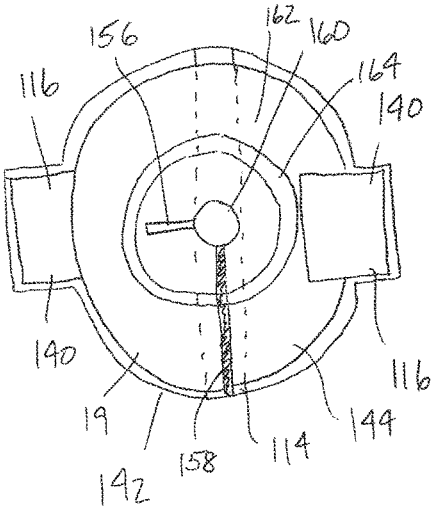

LIGHT BUTTON DEVICE

CROSS-REFERENCE TO RELATED APPLICATION

This application is a continuation of U.S. application Ser. No. 14/216,545, filed Mar. 17, 2014, now U.S. Pat. No. 9,664,366, which claims the benefit of U.S. Application No. 61/792,932, filed Mar. 15, 2013, which are both hereby incorporated by reference herein in their entireties.

FIELD

The invention relates generally to light devices and, more specifically, to compact light devices.

BACKGROUND

Often an individual desires a light source focused to illuminate an area while performing a task or a light source directed in a general outward direction for visibility. Holding a flashlight is an option, but such lighting devices are often cumbersome and may detract from the task being completed because the flashlight must be held. As a result, hands-free lighting is often used because the individual desiring illumination does not need to hold the light source. Common types of hand-free lighting include light sources mounted to headgear or eyeglasses, but such hand-free lighting can be relatively expensive such as when incorporated into headgear or eyeglasses and be relatively bulky requiring more space for their storage than may be desirable.

BRIEF DESCRIPTION OF THE DRAWINGS

FIG. 7 is a cross-sectional view of another lighted button showing a battery pivoted about a fulcrum to an off configuration;

FIG. 8 is a cross-sectional view of the lighted button of FIG. 7 showing the battery pivoted about the fulcrum to an on configuration;

FIG. 9 is a top plan view of the lighted button of FIG. 7 showing the battery pivoted about the fulcrum to the on configuration;

FIG. 10 is a cross-sectional view of another lighted button showing a battery pivoted about a fulcrum to an off configuration;

FIG. 11 is a cross-sectional view of the lighted button of FIG. 10 showing the battery pivoted about the fulcrum to an on configuration;

FIG. 12 is a top plan view of the lighted button of FIG. 10 showing the battery pivoted about the fulcrum to the on configuration;

DETAILED DESCRIPTION OF THE PREFERRED EMBODIMENTS

Compact light devices are provided herein that are advantageously configured to be secured to a surface in order to provide inexpensive lighting forwardly therefrom. Specifically, a variety of light button devices are described herein. The buttons each include on and off configurations in order to preserve battery life and allow a user to selectively energize the light source. The construction and materials used, however, can advantageously be selected so that each button is relatively inexpensive, so that when a battery is depleted or a user no longer needs the button, the button can be discarded.

Figure 1:
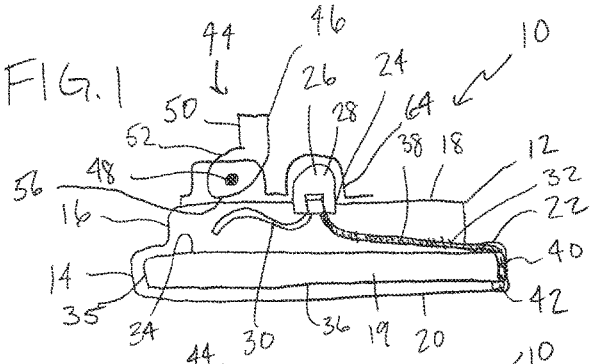
FIG. 1 is a side elevational view of a lighted button showing a light assembly with a switch device in an off configuration.
Figure 2:
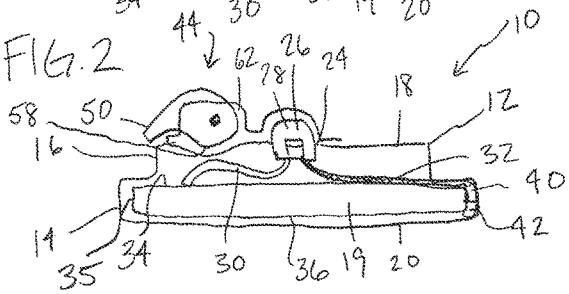
FIG. 2 is a side elevational view of the lighted button of FIG. 1 showing the switch device in an on configuration.
Figure 3:
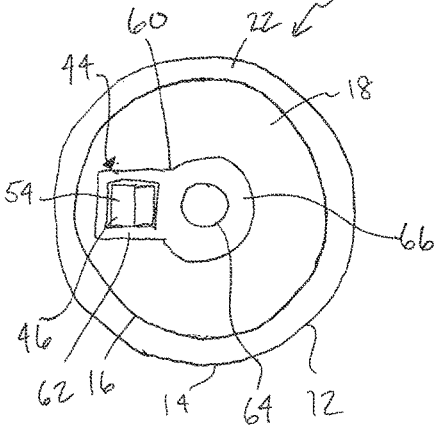
FIG. 3 is a top plan view of the lighted button of FIG. 1 showing the switch device in the off configuration.

Light button device 10 shown in FIGS. 1-3 includes a housing 12 having a stepped configuration with an annular lower wall portion 14, an annular upper wall portion 16, and circular top and bottom walls 18, 20. As shown, the diameter of the lower portion 14 is greater than the diameter of the upper portion 16, creating an offset or shoulder wall portion 22. The lower portion 14 has a depth and diameter sized to receive a generally disc shaped, coin cell battery 19 therein, e.g. a diameter of about 20 mm and a depth of about 3 mm. Advantageously, the diameter of the battery 19 is greater than the diameter of the upper wall portion 16, so that the battery 19 is held within the lower wall portion 14 by its outer edges being sandwiched between the offset wall portion 22 and the bottom wall 20.

The top wall 18 includes an opening 24 in a generally central location thereof. The opening 24 is sized to receive a light source 26 therein, which can be secured to the edges of the openings by any suitable methods, including adhesive, ultrasonic welding, or the like, or can be attached as described below. The light source 26 is preferably an LED having a lens portion 28 and first and second leads 30, 32 extending outwardly from the lens portion 28. As is understood, the battery 19 includes anode and cathode main surfaces 34, 36, and the battery 19 can energize the LED 26 by one each of the first and second leads 30, 32 contacting the anode and cathode surfaces 34, 36, respectively. As shown, the second lead 32 extends along the battery anode surface 34 and wraps around the annular edge surface 35 of the battery 19 to the cathode surface 36 thereof. The second lead 32 includes insulation 38 therearound that extends from adjacent to the LED 26 to a position adjacent a distal end 40 of the second lead 32 so that the second lead 32 has a non-insulated end portion 42. So configured, the second lead 32 electrically couples with the cathode surface 36 and is insulated from electrically coupling with the anode surface 34. Of course, the battery 19 can be flipped so that the leads engage the opposite battery surfaces.

In the off configuration, as shown in FIG. 1, the first lead 30 is spaced from the anode surface 34 so that it is not electrically coupled thereto. In an on configuration, as shown in FIG. 2, the first lead 30 is deflected into electrical engagement with the anode surface 34 with the second lead 32 always being electrically coupled to the cathode surface 36.

In order to shift the button 10 between the on and off configurations, the button 10 further includes a switch mechanism 44 that is configured to selectively deflect the top wall 18 to thereby selectively deflect the first lead 30 into electrical engagement with the battery anode surface 34. In this regard, the wall 18 can be of a shape retentive, resilient material that can be deformed upon application of force thereto but will return to its original configuration when the deforming force is removed. The first lead 30 is also preferably constructed from a resilient material so that it can repeatedly deflect and at least substantially return to a non-deflected position. The switch mechanism 44 includes a cam switch actuator member 46 that can be rotated about a pivot connection 48 and that includes a handle portion 50 and a base portion 52. The base portion 52 has a rounded outer edge 54 and includes a first portion 56 that is at a relatively small distance from the pivot 54 and a second portion 58 that is at a larger distance from the pivot 54 relative to first portion 56. In the off configuration, as shown in FIG. 1, the base first portion 56 is positioned adjacent to the top wall 18 so the top wall 18 generally is not deflected or is not deflected sufficiently to cause the lead 30 to be pushed into engagement with the battery 19. In the on configuration, as shown in FIG. 2, the base second portion 58 is rotated to a position adjacent to the top wall 18, and, as a result of its larger distance from the pivot 48, the base second portion 58 cams against and deflects the top wall 18 downwardly.

The switch member 46 is held in place by a frame 60 with upstanding wall portions 62 laterally adjacent to the switch base portion and coupled thereto by the pivot connection 48, which can be a pivot shaft such as a pin, rod, or the like. The frame 60 further includes a dome portion 64 configured to cover the light source opening 24 and the LED 26 mounted therein. The frame 60 is secured to the housing top wall 18 at a flanged base 66 thereof by any suitable method, including ultrasonic welding, adhesive, or the like.

Figure 4:
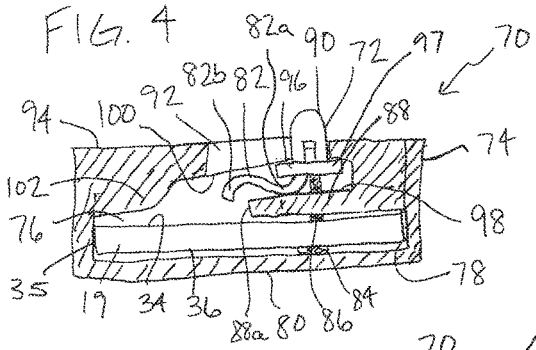
FIG. 4 is a cross-sectional view of another lighted button showing a light assembly with a light source switch in an off configuration.
Figure 5:
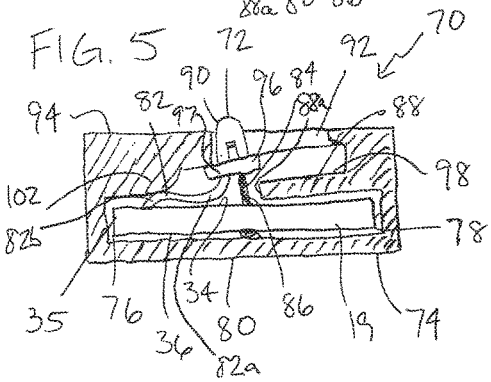
FIG. 5 is a cross-sectional view of the lighted button of FIG. 4 showing the light source switch in an on configuration.
Figure 6:
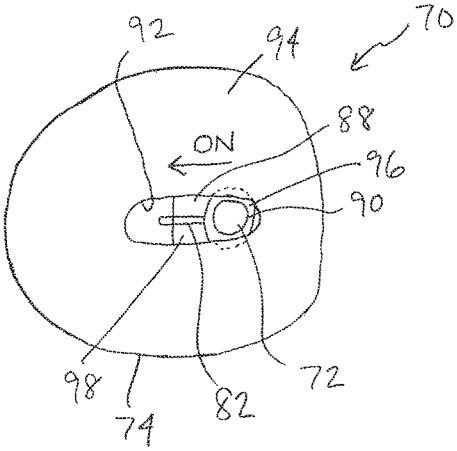
FIG. 6 is a top plan view of the lighted button of FIG. 4 showing the light source switch in the off configuration.

Another light button device 70 is shown in FIGS. 4-6. In this form, a light source 72 itself is the switch actuator member to shift the button 70 between on and off configurations. The button 70 includes a housing 74 having a bottom cavity 76 defined by an interior annular side surface 78 and a bottom wall 80 of the housing 74. The cavity 76 is sized to receive the coin cell battery 19 having the previously discussed anode and cathode surfaces 34, 36. Moreover, the light source 72 includes first and second leads 82, 84. As in the light device 10, the second lead 84 extends to the cathode surface 36 to electrically couple therewith and includes insulation 86 thereon to avoid electrical coupling with the anode surface 34.

In the off configuration shown in FIG. 4, a radially inwardly protruding dividing wall 88 spaces the LED 72 and, specifically, the first lead 82 thereof, from the anode surface 34. A lens portion 90 of the LED 72 is positioned within a slot opening 92 defined in a top wall 94 of the housing 74. Advantageously, the LED 72 can include a base 96 at the bottom of the lens portions 90 that includes a rim portion 97 projecting radially outwardly beyond the bottom of the lens portion 90. The base 96 has a diameter greater than the width of the opening 92 so that the LED 72 cannot be removed therethrough. So configured, the LED 72 can be laterally shifted by a user along and in the slot opening 92 with base 96 spaced over the dividing wall 88. In this regard, it can be seen that the LED lead 82 has a downwardly curved portion **82*a* that rides on the dividing wall 88 with the LED 72 in an off configuration thereof until the LED 72 is shifted sufficiently toward the on position so that the curved portion 82*a* clears the inner free end 88*a* of the wall 88. In order to aid in the lateral shifting of the LED 72, a top surface 98 of the spacing wall 88** can be downwardly inclined.

Moreover, a downwardly facing surface 100 of the top wall 94 adjacent to the opening 92 can also be downwardly inclined. As such, as the LED 72 is shifted along the opening 92, the LED 72 is also driven downwardly toward the battery 19. If desired, this downward driving of the LED 72 can bring the first lead 82 into electrical engagement with the anode surface 34 of the battery 19 to thereby energize the LED 72. By a further approach, the housing top wall 92 can include a downward protrusion 102 positioned radially beyond the slot opening 92, generally aligned therewith so that as the LED 72 is shifted along the slot opening 92, a distal upwardly curved portion **82*b* of the first lead 82 engages and is cammingly driven downward by the protrusion 102. As illustrated, the lead 82 with the oppositely curved portions 82*a* and 82*b* has an S-shaped configuration. The first lead 82 is preferably constructed from a resilient material so that it can repeatedly deflect and at least substantially return to a non-deflected position. Additionally, due to the resiliency of the first lead 82, the LED 72 can be urged tightly against the top wall downwardly facing surface 100 to retain the LED 72 in the on position so that the button 70 remains in the on configuration. Then, when a user is finished and no longer needs lighting, the user can shift the LED 72 back onto the spacing wall 88. The resilient engagement of the downwardly curved portion 82*a* of the LED lead 82 on the driving wall 88 urges the LED base 96 into tight engagement with the top wall inner surface 100 to retain the LED 72** in the off position.

In the light button devices 110, 112, shifting between on and off configurations occurs by pivoting the battery 19 about a fulcrum 114. Retaining structures or detents 116 of the buttons 110, 112 hold the battery 19 in first and second pivoted positions, which correspond to on and off configurations respectively.

The lighted button device 110 shown in FIGS. 7-9 includes a tubular housing 117 having a bottom wall 118, a top wall 120, and a generally annular sidewall 122 extending therebetween. The fulcrum 114 is mounted centrally across the bottom wall 118 and projects upwardly therefrom. The retaining structures 116 of the button device 110 include radially inwardly projecting wall portions or detents 124 of the sidewall 122 that are laterally or radially outward of the fulcrum 114, as shown in the top view of FIG. 9. The diameter of the sidewall 122 is sized and the fulcrum 114 is positioned so that the battery 19 rests in an oblique angled position with an edge portion thereof supported and resting on one of the detents 124 and an opposite edge thereof supported and resting on the bottom wall 118.

The light button device 110 further includes a light source 126, which is preferably an LED having a lens portion 128 and first and second leads 130, 132 extending outwardly from the lens portion 128. As shown in FIGS. 7 and 8, the second lead 132 extends down past the battery anode surface 34 and wraps around the battery annular edge surface 35 to the cathode surface 36 thereof to lay along the fulcrum 114 to ensure that the second lead 132 stays in contact with the cathode surface 36 as the battery 19 is pivoted. As with the previous forms, the second lead 132 includes insulation 134 therearound so that the second lead 132 is insulated from electrically coupling with the anode surface 34. The LED 126 is mounted within a transparent dome portion 136 of the top wall 120 and the first lead 130 extends away from the lens portion 128 to a position laterally adjacent to one of the detents 124.

So configured, with the battery 19 in the off configuration, as shown in FIG. 7, the first lead 130 is spaced from the battery anode surface 34 with the battery 19 engaged with and resting on the detent 124 generally opposite of the first lead 130 across the housing 117. Next, with the battery 19 in the on configuration, as shown in FIG. 8, the first lead 130 is engaged with the battery anode surface 34 to be electrically coupled thereto and the battery is engaged with and resting on the detent 124 adjacent to the first lead 130. The first lead 130 is preferably constructed from a resilient material so that it can repeatedly deflect and at least substantially return to a non-deflected position.

The top wall 120 and sidewall 122 are preferably configured to resiliently flex. This allows a user to depress the top wall 120 which compresses the sidewall 122. Using this action and the fulcrum 114, the user can shift the battery 19 off of and past the detent 124 and pivot the battery 19 about the fulcrum to shift the button 110 between on and off configurations.

In the light button device 112 shown in FIGS. 10-12, the retaining structure 116 includes a pair of thin diametrically opposite resilient whisker portions or detents 140 that are configured to support a radially outer edge portion of the battery 19 and resiliently deflect so that the battery 19 can be pivoted about the fulcrum 114.

The light button device 112 has a housing 142 of the button 112 includes upper and lower portions 144, 146 with sidewalls 148 extending from edges thereof. As illustrated, the sidewalls 148 taper outwardly. The upper and lower portions 144, 146 include lateral outward projections 148 that are configured to connect to capture the detents 140 therebetween. The detents 140 can be secured to the sidewalls 148 by any suitable method, including adhesive, ultrasonic welding, or the like. The whisker detent portions 140 can be separate whisker members or can be opposite portions of an annular whisker ring.

The fulcrum 114 is mounted centrally across a bottom wall 150 of the lower housing portion 146 positioned between the detents 140. The housing portions 144, 146 are sized and the fulcrum 114 is positioned so that the battery 19 rests in an obliquely angled position with an edge portion thereof engaged and resting on one of the detents 140 and an opposite edge thereof engaged and resting on the bottom wall 150.

The lighted button device 112 further includes a light source 152, which is preferably an LED having a lens portion 154 and first and second leads 156, 158 extending outwardly from the lens portion 154. As shown, the light source 152 can be mounted within a dome portion 160 of a top wall 162 of the housing 142 with the leads 156, 158 positioned similarly to that described above with respect to the light button device 110 of FIGS. 7-9.

So configured, with the battery 19 in the off configuration, as shown in FIG. 10, the first lead 130 is spaced from the battery anode surface 34 with the battery resting on the detent 140 opposite of the first lead 156. Next, with the battery 19 in the on configuration, as shown in FIG. 11, the first lead 156 is electrically coupled with the battery anode surface 34 and the battery 19 is resting on the detent 140 adjacent to the first lead 156.

The housing portions 144, 146 are preferably configured to resiliently flex. This allows a user to compresses the housing 142. Using this action and the fulcrum 114, the user can shift the battery 19 off of the detent 140 and pivot the battery 19 about the fulcrum 114 to shift the button 110 between on and off configurations.

If desired, the top wall 162 can include one or more downward protrusions 164 positioned radially intermediate of the whisker 140 and the LED 152. In the illustrated form, the protrusion 164 is an annular ring of the top wall 162. The protrusion 164 aids a user in contacting the battery 19 during shifting of the button 112 between on and off configurations, so that a user can compress the housing 142 by a smaller distance.

Figure 13:
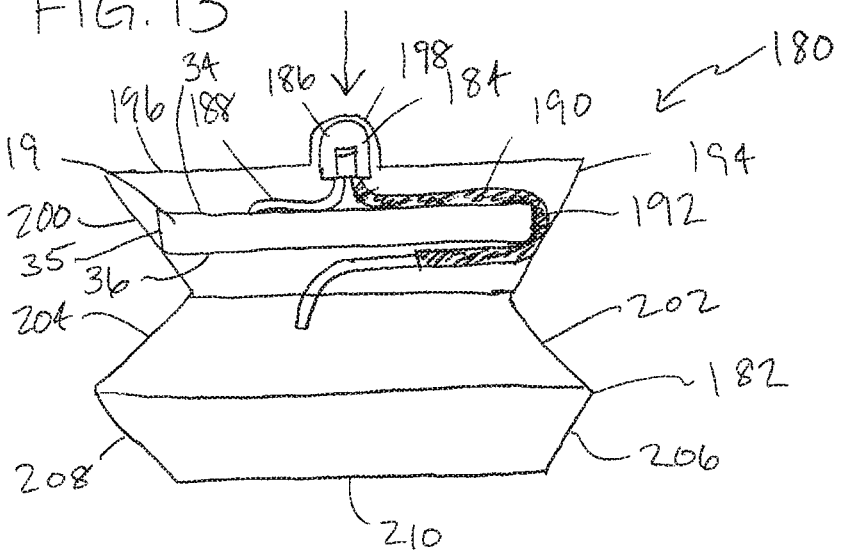
FIG. 13 is a cross-sectional view of another lighted button showing a housing in an expanded off condition with a lead of a light source spaced from a bottom surface of a battery.
Figure 14:
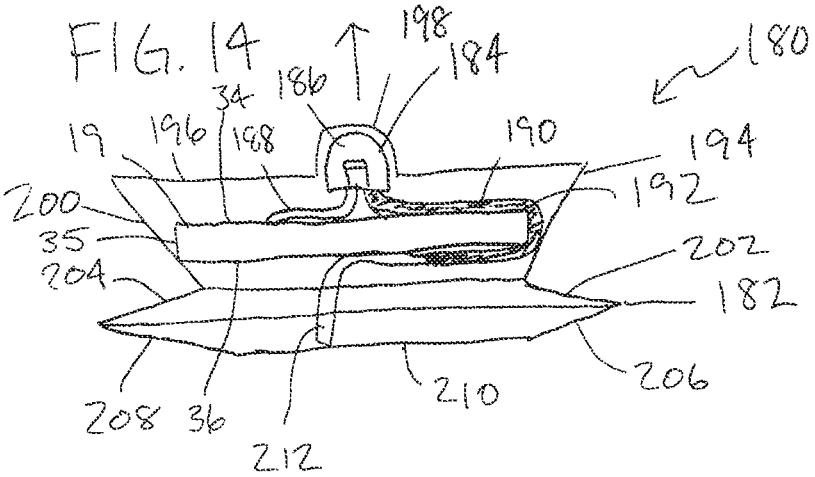
FIG. 14 is a cross-sectional view of the lighted button of FIG. 13 showing the housing in a collapsed on condition with the lead electrically engaged with the bottom surface of the battery.
Figure 15:
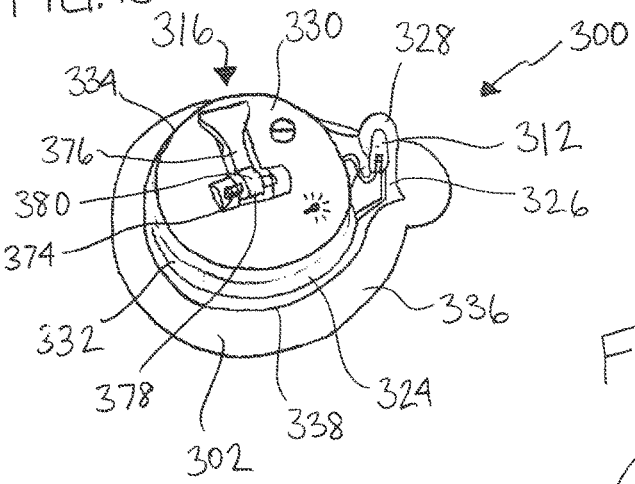
FIG. 15 is a perspective view of another lighted button showing a light assembly with a pivoting switch device in an off configuration.
Figure 16:
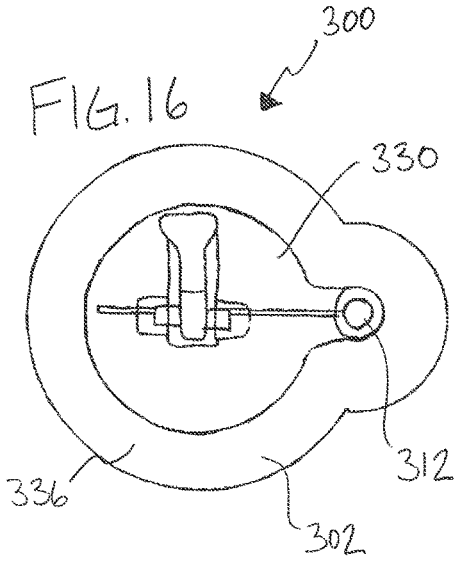
FIG. 16 is a top plan view of the lighted button of FIG. 15 showing the pivoting switch device in the off configuration.

In another approach, as shown in FIGS. 13 and 14, a light button device 180 includes a collapsible housing 182 that is configured to be collapsed to shift to an on configuration (FIG. 14) and be expanded to shift to an off configuration (FIG. 13). As shown, the button 180 includes a light source 184 which is preferably an LED having a lens portion 186 and first and second leads 188, 190. In contrast to the earlier described devices, the first lead 188 is always in electrical engagement with the anode surface 34 of the battery and the second lead 190 is spaced from the battery cathode surface 36. Insulation 192 keeps the second lead 190 from electrically engaging the battery anode surface 34.

The housing 182 can have a bellowed configuration and includes a top portion 194, intermediate portion 202, and bottom portion 206. The top portion 194 includes a top wall 196 with a transparent dome portion 198 sized to receive the LED lens portion 186 therein and a radially or laterally inwardly tapered sidewall 200 that depends from the outer edge of the top wall 196. As shown, the sidewall 200 tapers to a diameter that is smaller than the diameter of the disc-shaped battery 19, so that the battery is trapped and retained within the interior space of the housing top portion 194. The housing intermediate portion 202 connects to the top portion 194 at a bottom thereof and has radially or laterally outwardly tapering sidewall 204. Finally, the housing bottom portion 206 connects to the intermediate portion 202 at a bottom thereof and has a radially or laterally inwardly tapering sidewall 208 and a bottom wall 210. So configured, at least the bottom and intermediate portions 206, 202, can be collapsed by a user of the button device 180, as shown in FIG. 14. The top portion 194 may also be collapsible to aid in shifting the device 100 to the on configuration.

As shown in FIGS. 13 and 14, the LED second lead 190 includes a downwardly extending end portion 212. When the user collapses the housing 182, the second lead end portion 212 abuts the bottom wall 210 causing the second lead 190 to shift upwardly into electrical engagement with the battery cathode surface 36. The second lead 190 is preferably constructed from a resilient material so that it can repeatedly deflect and at least substantially return to a non-deflected position.

Another light button device 300 is shown in FIGS. 15-19 that has a similar operation to that of the light button device 10 shown in FIGS. 1-3. In this form, the light button device 300 includes a three-piece housing 302 having a base portion 304, a first, outer cover portion 306, and a second, inner cover portion 308. The first and second covers 306, 308 are configured to nest together, with the proportionally smaller second cover 308 disposed within the larger first cover 306. With the first and second covers 306, 308 in this nested configuration, the housing 302 is assembled by connecting at least the outer cover 306 to the base 304 to be sealed relative thereto so that the housing 302 is waterproof.

The light button device further includes a light assembly 310 configured to be disposed within or mounted to the housing 302 so that when turned on light is projected away from the housing 302. The light assembly 310 includes a light source 312, a power source 314, and a switch device 316. Of course, the button devices described herein can be modified to include any desired number of light sources, batteries, or switch devices. In the illustrated embodiment, the light source 312 is a light emitting diode having a lens portion 318, first and second leads 320, 322, and an illumination chip 323. The power source 314 can be one or more coin cell batteries, such as in a stacked configuration as shown, to reduce the width or footprint of the housing 302. Additional details of the light assembly 310 will be described with reference to the housing 302 below.

As illustrated, the first and second covers 306, 308 have a generally similar shape and configuration, with the first cover 306 being slightly proportionally larger so that the second cover 308 can be disposed therein. As such, each cover 306, 308 includes a cylindrical main body portion 324 and a projection 326 extending radially outwardly therefrom having a domed top portion 328. So configured, the main body portion 324 can be sized to snugly receive the coin cell batteries 314 therein and the projection 326 and its domed top portion 328 thereof can be sized to snugly receive the lens 318 of the light source 312 therein so that the light source 312 is positioned laterally adjacent to the batteries 314. The housing base 304 is generally planar with a circular main portion 331 configured to be aligned with and support the cover main body portion 324 and a protruding portion 333 extending radially outwardly from the circular main portion 324 configured to be aligned with and support the cover projection 326.

Turning now to more details of the housing 302, each cover 306, 308 includes a top wall portion 330 that extends generally parallel to the base 304 when the covers 306, 308 are attached thereto and a sidewall portion 332 that extends downwardly from an outer edge portion 334 of the top wall portion 330. A bottom flange portion 336 that is configured to abut and be sealed to the base 304 extends outwardly from a lower edge portion 338 of the sidewall 332. As shown, the flanges 336 have a similar configuration as an outer edge portion 340 of the base 304 with a ring-shaped main body portion 342 and a rounded projection 344 extending off of the main body portion 342. Preferably, an outer edge 346 of one or both of the flanges 336 is shaped or cut to align with an outer edge 348 of the base 304. In one approach, only the flange 336 of the first cover 306 is sealed to the base 304. In another approach, the flanges 336 of both the first and second covers 306, 308 are sealed to the base 304.

As is understood, the batteries 314 include anode and cathode main surfaces 350, 352, and the batteries 314 can energize the LED 312 by one each of the first and second leads 320, 322 contacting the anode and cathode surfaces 350, 352, respectively. Of course, the batteries 314 can be flipped so that the leads engage the opposite battery surfaces.

As shown, the second lead 322 includes a vertical portion 354 that extends downwardly from the illumination chip 323 and a transverse portion 356 that extends along the base 304 to a position underneath the lower battery 314 so that the second lead 322 is always in electrical engagement with the cathode surface 352 thereof. In the illustrated form, the vertical portion 354 of the second lead 322 is sized to abut the base 304 so that the LED lens 318 is elevated in and abuts the domed top portion 328 of the second cover 308. As such, if desired, the transverse portion 356 of the second lead 322 can include an upwardly arched portion 357 so that the transverse portion 356 is spaced slightly from the base 304 in an undeflected state. Then, with the batteries 314 disposed within the housing 304, the transverse portion 356 is slightly deflected downwardly thereby ensuring electrical contact as well as providing a bias force to urge the batteries 314 upward.

Figure 17:
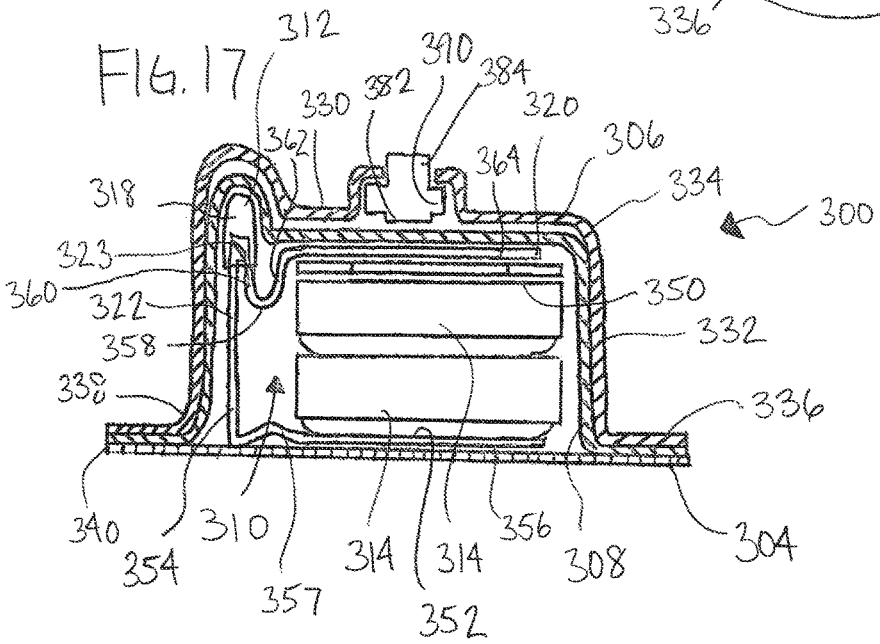
FIG. 17 is a side cross-sectional view of the lighted button of FIG. 15 showing the pivoting switch device in the off configuration.

The first lead 320, shown in FIG. 17, includes a U-shaped portion 358 having a first leg 360 connected to the illumination chip 323 and a second leg 362 that extends upwardly to the top wall 330 of the second cover 308, and a transverse portion 364 that extends along the top wall 330 and over the anode surface 350 of the upper battery 314. In order to space the first lead transverse portion 364 from the anode surface 350, an o-ring member 366 of insulating material, or other insulating member having an open middle portion, is disposed between the first lead 320 and the battery 314. So configured, the first lead 320 is spaced from the battery 314 in an undeflected or off configuration. Then, when a user desires to energize the LED 312, the user can depress the top wall 330 until the first lead 320 is deflected into contact with the battery anode surface 350.

In the illustrated form, the top wall 330 of the second cover 308 includes two pairs of projections or guides 368 that extend downwardly. The first lead transverse portion 364 is configured to extend along the top wall 330 between each pair of guides 368. The pairs of guides 368 can be positioned adjacent to an inner edge 370 of the o-ring 366 to avoid interference with the ring 366 while also providing a flat middle region 371 of the top wall 330 for deflection by the switch device 316, which is described in more detail below.

With the above-described construction, the LED 312 and the batteries 314 are enclosed between the second cover 308 and the base 304. As such, when the flange 336 thereof is sealed to the base 304, water cannot access and damage these electronic components left off inert.

The switch device 316 of this form operates similarly to the switch device 44 shown in FIGS. 1 and 2. In order to shift the button 300 between on and off configurations, the switch device 316 is configured to selectively deflect the top wall 330 of the second cover 308 to thereby selectively deflect the first lead 320 into electrical engagement with the battery anode surface 250. In this regard, the top wall 330, as well as the rest of the first and second covers 306, 308, can be of a shape retentive, resilient material that can be deformed upon application of force thereto, but will substantially return to its original configuration when the deforming force is removed. The first lead 220 is also preferably constructed from a resilient material so that it can repeatedly deflect and return to a non-deflected position.

Figure 18:
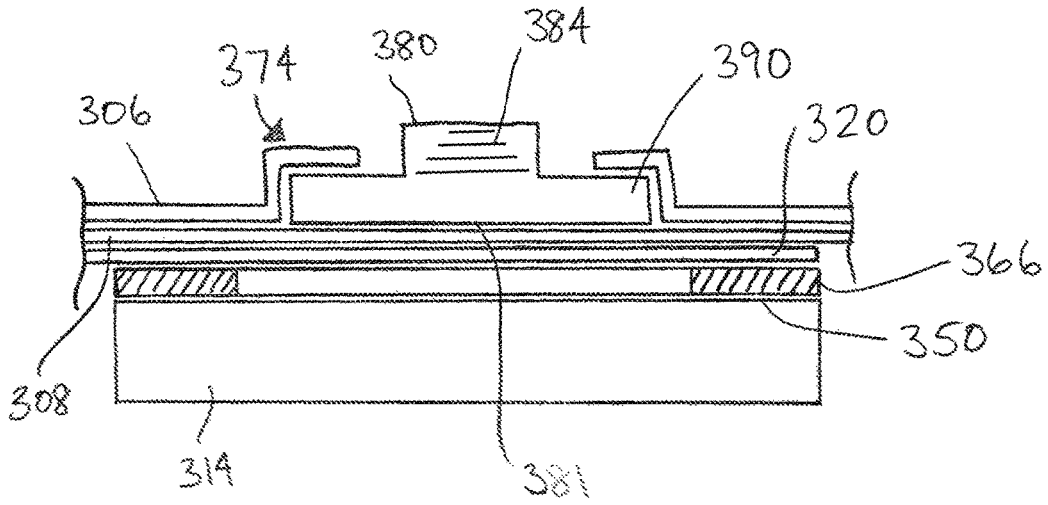
FIG. 18 is a sectional view of the lighted button of FIG. 15 showing an off configuration with the first lead spaced from a battery surface.
Figure 19:
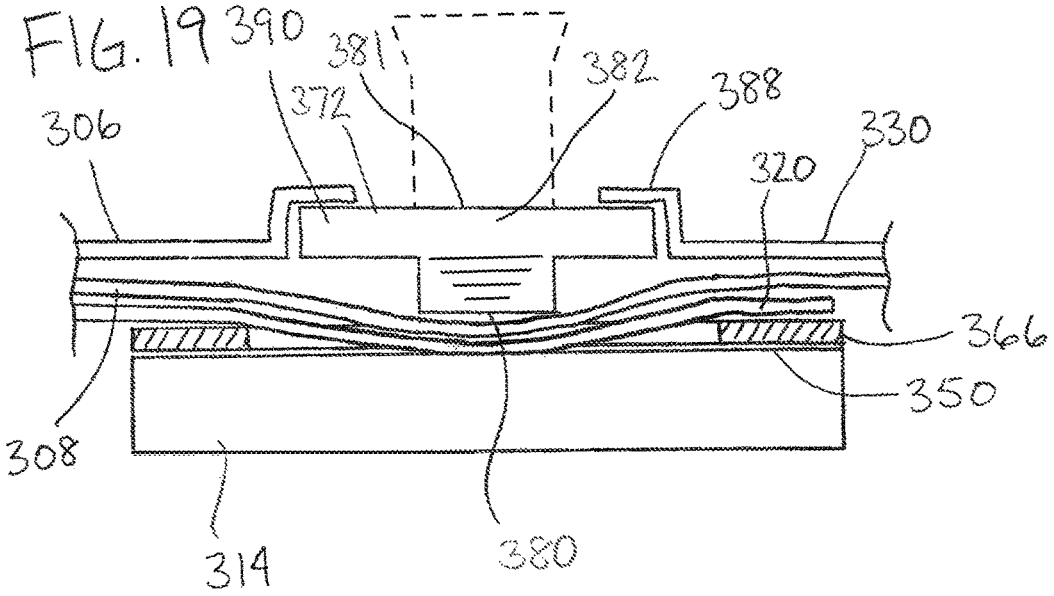
FIG. 19 is a sectional view of the lighted button of FIG. 15 showing the on configuration with the first lead deflected into engagement with the battery surface.
Figure 20:
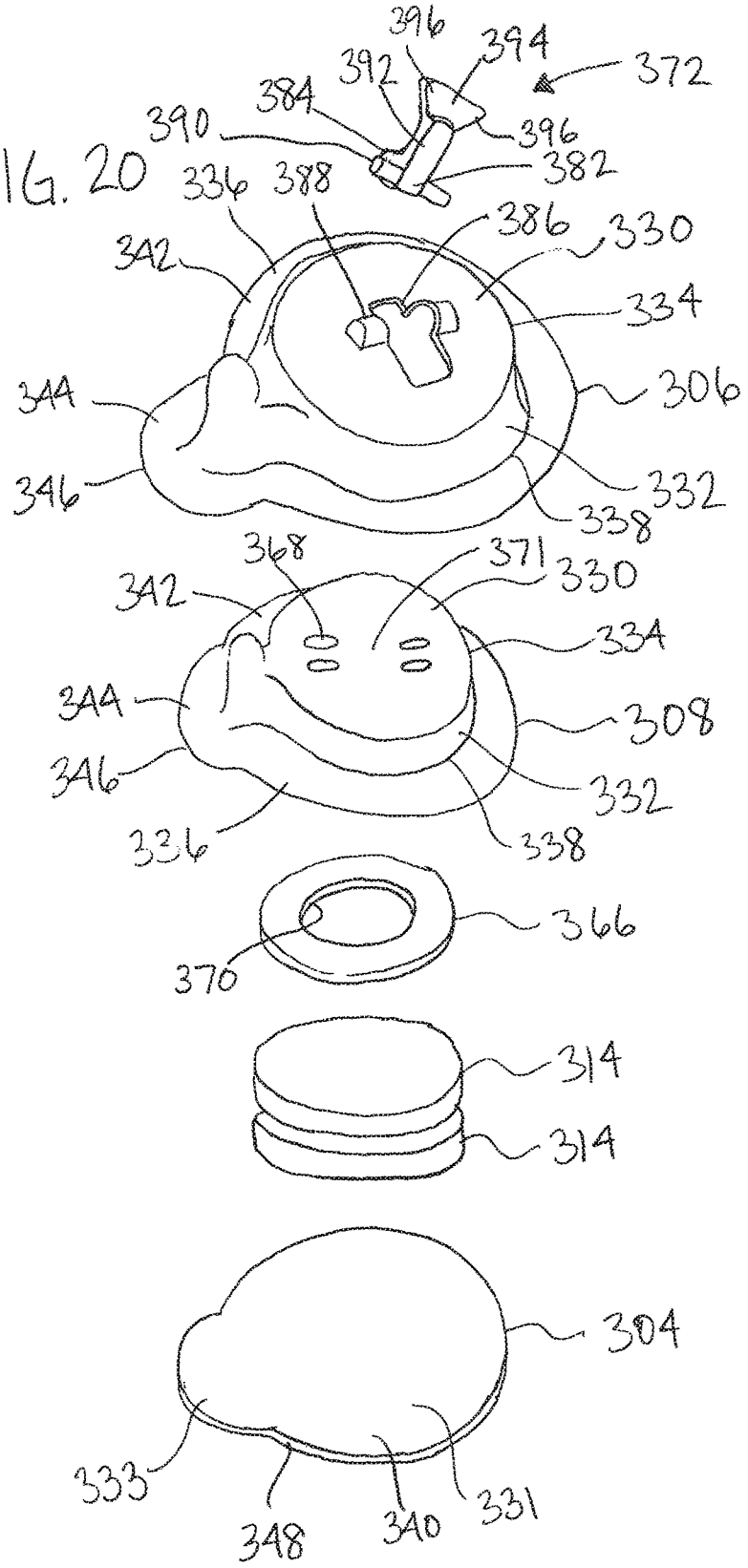
FIG. 20 is an exploded perspective view of the lighted button of FIG. 15.

The switch device 316 includes a cam switch actuator member 372 that can be rotated about a pivot connection 374 and includes an elongate handle portion 376 and a base portion 378. The base portion 378 has a first portion 382 that is at a relatively small distance from the pivot 374 and a second portion 384 that is at a larger distance from the pivot 374 relative to first portion 382. The second portion 384 can include a rounded outer edge 380 so that it extends further away from the pivot 374 than the first portion 382, which can have a flattened or straight outer edge 381 that is closer to the pivot 374. In the off configuration, as shown in FIGS. 17 and 18, the base second portion 384 is positioned so that the curved outer edge 380 thereof generally faces away from the top wall 330 of the second cover 308 so as not to be engaged therewith and the flattened outer edge 381 of the first portion 382 generally faces the top wall 330 to extend along and adjacent thereto. In this manner, the top wall 330 generally is not deflected or is not deflected sufficiently to cause the first lead 220 to be pushed into engagement with the battery 314. In the on configuration, as shown in FIG. 19, the base second portion 384 is positioned so that the curved outer edge 380 thereof generally faces the top wall 330 of the second cover 308 so as to be engaged therewith and the flattened outer edge 381 of the first portion 330 generally faces away from the top wall 330.

To turn the light source 312 on, the actuator member 372 is rotated from the off configuration towards the on configuration. This causes the curved outer edge 380 of the base second portion 384 to engage the top wall 330 of the second cover 308 and, with continued rotation, to deflect the top wall 330 downwardly. Advantageously, friction between the top wall 330 and the curved outer edge 380 can cause the switch actuator member 372 to remain in the on configuration. For example, the base second portion 384 can be sized to deflect the top wall 330 sufficiently to energize the light source 312 with the switch actuator member 372 rotated to a position where the elongate handle portion 326 extends at an angle to a plane of the top wall 330, that is generally equal to or slightly past 90 degrees. As such, the switch actuator member 372 can preferably generate sufficient friction with the top wall 330 to remain in the on configuration at this point. Continued rotation of the switch actuator member 372 can be used to position the elongate handle portion 326 of the member 372 so that it generally extends along the top wall 330. When use of the light button device 300 is finished, a user can simply rotate the switch actuator member 372 back towards the off configuration with the flattened outer edge 381 of the first portion 330 generally facing the top wall 330. Due to the resilient nature of the top wall 330, once the user has rotated the switch actuator member 372 past the point of significant frictional engagement between the top wall 330 and the curved outer edge 380, such as generally 90 degrees relative to the top wall 330, the switch actuator member 372 may be biased to spring back to the off configuration.

Advantageously, the first cover 306 holds the switch member 372 in place above the top wall 330 of the second cover 308, similar to the switch frame 60 so that the first cover 306 alternatively can be referred to as switch frame 306. As shown, the top wall 330 of the first cover 306 includes a slot opening 386 therein that is slightly offset to one side thereof and has a generally rectangular configuration. On either side of the opening 386 generally centrally on the top wall 330 are two upward trunnion projections 388 that create two arched surfaces curved upwardly from the top wall 330. In one form, the pivot connection 374 of the switch device 316 includes two pivot shafts 390 that project laterally outwardly from the switch member base 378. The opening 386 is sized such that the posts 390 project into the projections 388 under the arched surfaces 388*a* and 388*b* thereof and thus, when the first cover 306 is sealed to the base 304 over the second cover 308, the switch member 372 is secured to the light button 300 via the shafts 390 being captured between the first and second covers 306, 308. So configured, the switch member 372 can be rotated between the on and off configurations.

If desired, the switch member handle portion 376 can further include a rear portion 392 connected to the base 382 and a forward grip portion 394. As shown, the rear portion 392 has a thickness sized so that it projects into the opening 386 when the switch is in the off configuration, while the forward grip portion 394 has a relatively thin thickness to be sized to rest on the top wall 330 of the first cover 306. The forward grip portion 394 can include outwardly tapering sidewalls 396 to give the forward grip portion 394 more surface area for a user to grasp during use.

If desired, any of the light button devices described herein can include a securing mechanism mounted to the bottom walls thereof. The securing mechanism can be adhesive, which can include a cover release sheet thereover prior to use, a pin, Velcro, or the like. Alternatively, the light button devices can include a separate adhesive patch with release sheets on both sides thereof for mounting to the bottom surface of the light button devices to surfaces after purchase. Additionally, positions of the battery 19 as described herein with respect to the anode and cathode surface thereof can be flipped so that the leads engage the opposite battery surfaces.

It will be understood that various changes in the details, materials, and arrangements of the parts and components that have been described and illustrated in order to explain the nature of the lighted components as described herein may be made by those skilled in the art within the principle and scope of this disclosure.

The invention claimed is:

1. A compact light device comprising:

a housing having an interior that is sealed to be substantially waterproof;

a power source disposed in the housing interior and having anode and cathode surfaces;

a light emitting diode disposed within the housing interior and having a first lead spaced from one of the anode and cathode surfaces, and a second lead continuously electrically engaged with the other of the anode and cathode surfaces;

a switch device mounted to the housing outside the sealed interior thereof; and a cam actuator member of the switch device configured to be shifted between an off configuration and an on configuration such that in the on configuration, the cam actuator member deflects an adjacent portion of the housing so as to also deflect the first lead in the sealed housing interior into electrical engagement with the one of the anode and cathode surfaces to energize the light emitting diode.

2. The compact light device of claim 1 wherein the power source comprises a disc-shaped coin cell battery, and the housing has a cylindrical main body portion sized to snugly receive the coin cell battery therein and a domed projection laterally adjacent the cylindrical main body portion and sized to snugly receive the light emitting diode therein.

3. The compact light device of claim 1 wherein the power source comprises a disc-shaped coin cell battery such that the anode and cathode surfaces have a flat configuration, and the light emitting diode is arranged in the sealed housing interior to direct light therefrom in a generally transverse direction to the anode and cathode surfaces of the disc-shaped coin cell battery.

4. The compact light device of claim 3 wherein the housing has a light transmissive wall portion adjacent the light emitting diode.

5. The compact light device of claim 1 wherein the cam actuator member is pivotal and has a base portion including a curved outer surface portion sized such that with the cam actuator member pivoted to the on configuration, the curved outer surface portion engages and deflects the adjacent portion of the housing.

6. The compact light device of claim 5 wherein the base portion has an outer surface portion adjacent the curved outer surface portion that is sized such that with the cam actuator member pivoted to the off configuration, the outer surface portion faces the housing adjacent portion without causing deflection thereof sufficient to shift the first lead into electrical engagement with the one of the anode and cathode surfaces.

7. The compact light device of claim 5 wherein the cam actuator member has an elongate handle portion extending from the base portion, and the curved outer surface portion is configured so that with the elongate handle portion pivoted from the off configuration of the cam actuator member to a position extending generally orthogonal to the power source anode and cathode surfaces, the cam actuator member is in the on configuration and the curved outer surface portion allows the elongate handle portion to continue to be pivoted away from the off configuration toward the housing while the cam actuator member remains in the on configuration.

8. The compact light device of claim 7 wherein the base portion has a surface portion adjacent the curved outer surface portion that is sized so that with the elongate handle portion pivoted to extend generally orthogonal to the anode and cathode surfaces, there is a bias urging the elongate handle portion to pivot back toward the housing with the outer surface portion facing the housing adjacent portion so that the cam actuator member is in the off configuration.

9. The compact light device of claim 1 wherein the housing comprises first and second nested covers with the second cover disposed within the first cover and both first and second covers being configured to cover the power source and the light source.

10. The compact light device of claim 1 wherein the housing has a bottom wall and a securing mechanism mounted thereto, the securing mechanism including an adhesive and a cover release sheet over the adhesive.

* * * * *